US007278976B1

(12) United States Patent
Chen

(10) Patent No.: US 7,278,976 B1
(45) Date of Patent: Oct. 9, 2007

(54) BODY VIBRATOR

(75) Inventor: Ming Nan Chen, Taichung Hsien (TW)

(73) Assignee: Michael Lin, Chongsan Chu, Taipei (TW)

( * ) Notice: Subject to any disclaimer, the term of this patent is extended or adjusted under 35 U.S.C. 154(b) by 0 days.

(21) Appl. No.: 11/476,869

(22) Filed: Jun. 27, 2006

(51) Int. Cl.
*A61H 1/00* (2006.01)

(52) U.S. Cl. ..... 601/30; 601/49; 601/90; 601/93

(58) Field of Classification Search ..... 601/23, 601/24, 27, 29, 30–32, 46, 49, 50, 51, 53, 601/69, 84–87, 89, 90, 93, 97, 98, 100, 101, 601/104; 482/51–52
See application file for complete search history.

(56) References Cited

U.S. PATENT DOCUMENTS

| | | | | |
|---|---|---|---|---|
| 2,271,382 | A | 1/1942 | Worthington | |
| 2,935,064 | A | 5/1960 | Moxley | |
| 6,083,180 | A | 7/2000 | Shimizu | |
| 6,106,491 | A * | 8/2000 | Gianutsos | 601/104 |
| 6,572,568 | B2 * | 6/2003 | Huang | 601/29 |
| 2005/0033203 | A1 * | 2/2005 | Son | 601/98 |
| 2006/0155221 | A1 * | 7/2006 | Kim | 601/29 |

* cited by examiner

*Primary Examiner*—Quang D. Thanh
(74) *Attorney, Agent, or Firm*—Charles E. Baxley

(57) ABSTRACT

A body vibrator includes a platform disposed above a base, two support devices each having a pivotal arm coupled to the platform for pivotally supporting the platform above the base, a motor-driven reduction gearing device disposed on the base and having an eccentric member coupled to the arm of the one of the support devices for allowing the platform to be rotated and driven by the reduction gearing device. The platform may stably support a user and may be suitably vibrated for massaging the whole user' body and for facilitating the blood and/or lymph circulation of the user and for decomposing the fatty tissue and thus for suitably reducing the fat from the user.

8 Claims, 6 Drawing Sheets

BODY VIBRATOR

BACKGROUND OF THE INVENTION

1. Field of the Invention

The present invention relates to a body vibrator, and more particularly to a body vibrator including a stable structure for stably supporting a user thereon and for suitably vibrating and massaging the whole user' body and for facilitating the blood and/or lymph circulation of the user and for decomposing the fatty tissue and thus for suitably reducing the fat from the user.

2. Description of the Prior Art

Various kinds of typical body vibrators have been developed and comprise a platform for supporting the user thereon, and a hollow vibrator coil and a pair of armatures provided for vibrating the platform in order to suitably vibrate and massage the user who is standing on the platform.

For example, U.S. Pat. No. 2,271,382 to Worthington discloses one of the typical platform foot and body vibrator also comprising one of two armatures attached or secured to a platform and a hollow vibrator coil for acting with the armatures and thus for vibrating the platform in order to suitably vibrate and massage the user who is standing on the platform.

For moving or vibrating the platform, a great magnetic field and thus a great magnetic force are required to be generated by the hollow vibrator coil and the armatures. However, the magnetic field and the magnetic force generated by the hollow vibrator coil and the armatures are not good for the users and may have a good chance to hurt the users.

U.S. Pat. No. 2,935,064 to Moxley discloses another typical foot massage apparatus comprising a motor including a spindle or armature shaft coupled to an eccentric member which is indirectly coupled to a platform with a cylindrical member or a frame work, such that the platform may only be operated or vibrated or moved with a relatively smaller moving or vibrating stroke.

U.S. Pat. No. 6,083,180 to Shimizu discloses a further typical vibrator-type massaging device also comprising a motor coupled to two rotors each including an eccentric shaft extended upwardly therefrom for moving in circular and planar and horizontal plans such that the user may not be vibrated or moved up and down and such that the massaging effect is limited.

An additional motor may further be provided and coupled to a threaded shaft with a rotary gear for moving a vibrating plate up and down relative to a supporting casing. However, the moving speed of the vibrating plate by the threaded shaft and the motorized rotary gear is limited and may not be used to vibrate the vibrating plate and the users.

The present invention has arisen to mitigate and/or obviate the afore-described disadvantages of the conventional body vibrators.

SUMMARY OF THE INVENTION

The primary objective of the present invention is to provide a body vibrator including a stable structure for stably supporting a user thereon and for suitably vibrating and massaging the whole user' body and for facilitating the blood and/or lymph circulation of the user and for decomposing the fatty tissue and thus for suitably reducing the fat from the user.

In accordance with one aspect of the invention, there is provided a body vibrator comprising a base, a platform provided above the base, a first support device disposed on the base and including a first arm having a middle portion pivotally supported on the base and having a first end pivotally coupled to the platform for pivotally supporting the platform above the base and having a second end, a second support device disposed on the base and pivotally coupled to the platform for pivotally supporting the platform above the base, a reduction gearing device disposed on the base and including an eccentric member coupled to the second end of the first arm for allowing the first arm and the platform to be rotated and driven by the reduction gearing device, and a motor coupled to the reduction gearing device for driving the reduction gearing device to rotate and to vibrate the first arm and the platform.

The motor includes a spindle, the reduction gearing device includes a pulley attached thereto and coupled to the spindle of the motor with a belt for allowing the reduction gearing device to be rotated and driven by the motor.

The eccentric member of the reduction gearing device is coupled to the second end of the first arm with a lever for allowing the first arm and the platform to be rotated and driven by the reduction gearing device.

The first support device includes two plates disposed on the base and spaced away from each other, and a rod rotatably attached to the plates and straddled between the plates for pivotally supporting the first arm on the plates of the first support device.

The first arm includes at least two panels attached to the rod and secured to the platform for allowing the platform to be stably secured to and supported by the first arm and the rod. The base include a post extended upwardly therefrom for supporting a control device thereon.

The base include at least one handle device disposed thereon for supporting an upper portion of a user. The base include a housing engaged thereon for covering and shielding the first and the second support devices, the motor and the reduction gearing device.

The second support device includes a second arm pivotally supported on the base and pivotally coupled to the platform for pivotally supporting the platform above the base. The second support device includes two plates disposed on the base and spaced away from each other, and a rod rotatably attached to the plates and straddled between the plates for pivotally supporting the second arm on the plates of the second support device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
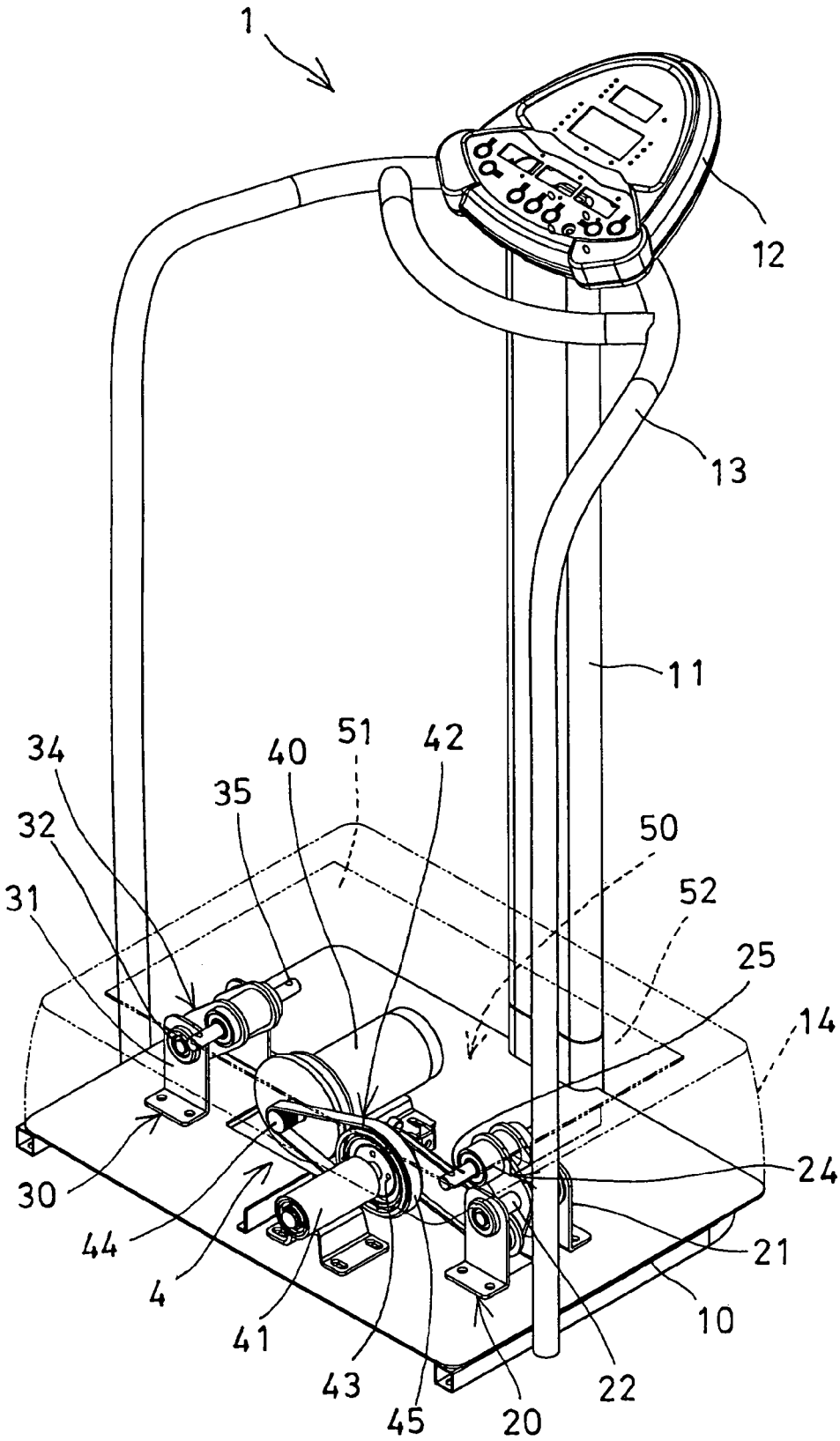
FIG. 1 is a partial perspective view of a body vibrator in accordance with the present invention.

Referring to the drawings, and initially to FIGS. 1-4, a body vibrator in accordance with the present invention comprises a base 10 for supporting two support devices 20, 30 and a vibrating device 4 thereon, and including a post 11 extended upwardly therefrom, such as extended upwardly from the front portion thereof for supporting a displayer or control device 12 thereon, and including one or more handle devices 13 disposed thereon and/or attached or coupled to the post 11 for supporting the upper portions of the users, and including a cover or housing 14 engaged or attached onto the base 10 for covering or shielding or protecting the support devices 20, 30 and the vibrating device 4 and for preventing the support devices 20, 30 and the vibrating device 4 from being exposed or reached by children.

The support devices 20, 30 are spaced away from each other, and each include one or more, such as two plates 21, 31 disposed on the base 10 and spaced away from each other and preferably parallel to each other, two rods 22, 32 rotatably attached or disposed to the plates 20 with bearings 23, 33 and disposed or straddled between the plates 21, 31 respectively, two arms 24, 34, such as a first arm 24 and a second arm 34 rotatably attached or secured to the plates 21, 31 of the support devices 20, 30 with the rods 22, 32 for allowing the arms 24, 34 to be rotated relative to the plates 21, 31 of the support devices 20, 30 with the rods 22, 32 respectively. A foot pedal or support or platform 50 is attached or secured to or on the support devices 20, 30, particularly supported on or pivotally coupled to the upper or free ends of the arms 24, 34 with pivot shafts 25, 35 respectively for allowing the platform 50 to be rotated or pivoted or swung or vibrated relative to the plates 21, 31 of the support devices 20, 30 and the base 10.

Figure 2:
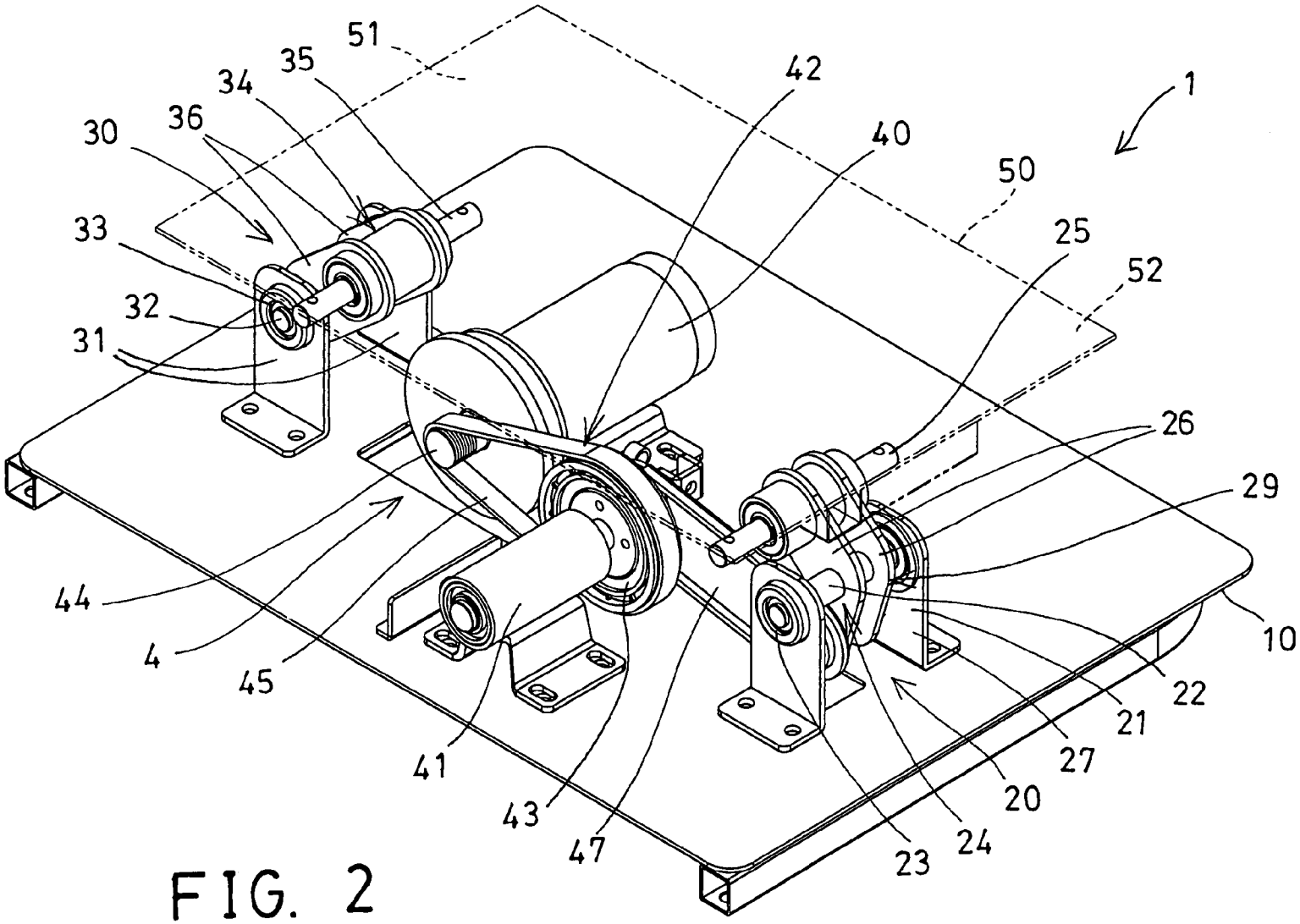
FIG. 2 is an enlarged partial perspective view illustrating a vibrating device of the body vibrator.
Figure 3:
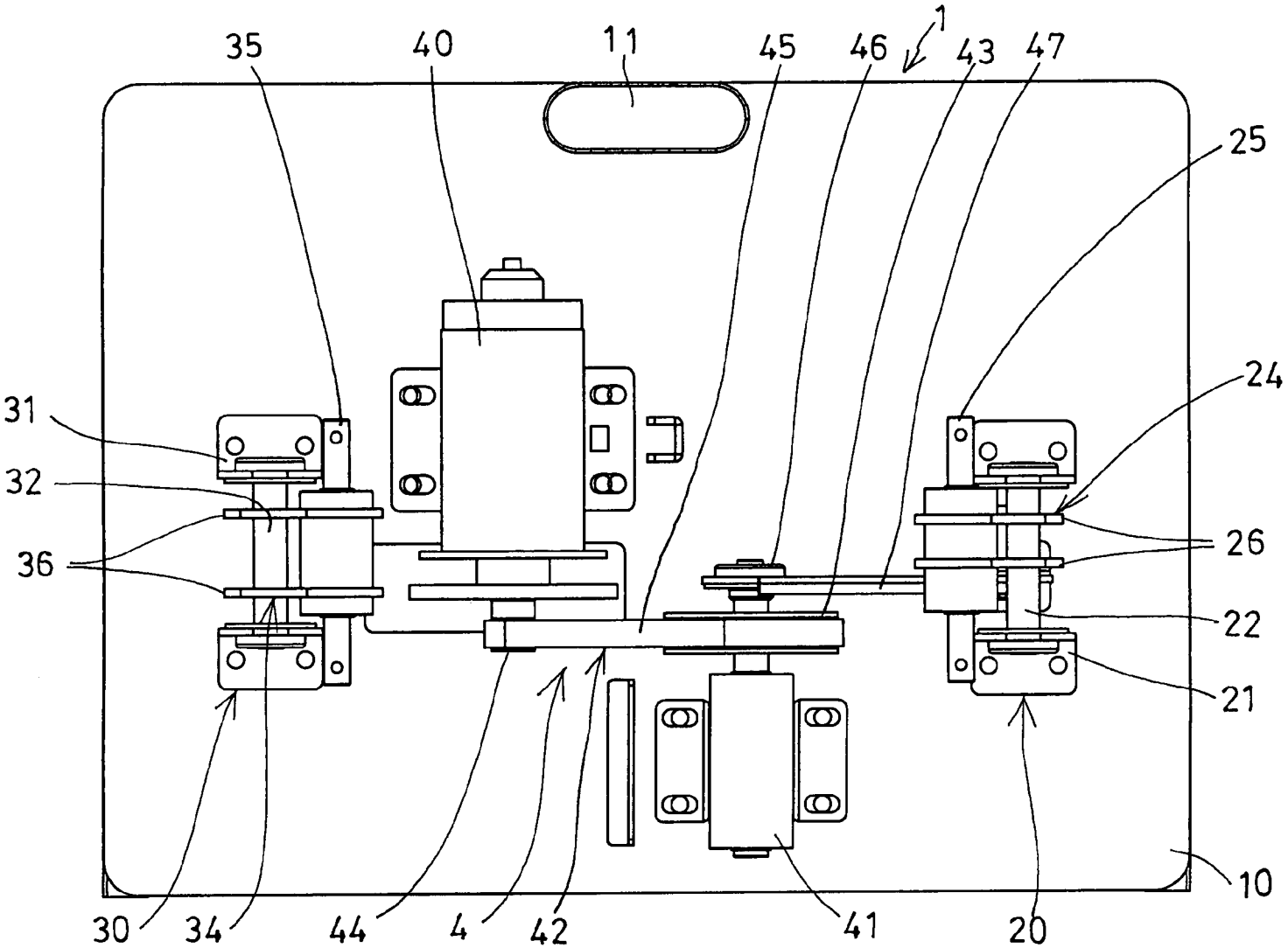
FIG. 3 is a partial top plan schematic view illustrating the vibrating device of the body vibrator.

As best shown in FIGS. 1-3, it is preferable that the arms 24, 34 each include two or more panels 26, 36 attached or secured to the rods 22, 32 and preferably parallel to each other and pivotally secured to the platform 50 with the rods 22, 32 respectively for allowing the platform 50 to be stably supported by the arms 24, 34 and the rods 22, 32 respectively and for preventing the platform 50 from being tilted or inclined relative to the arms 24, 34 and the rods 22, 32 respectively, and thus for allowing the users to be stably supported on the platform 50. It is further preferable that the arm 24 includes a middle portion 29 pivotally attached to the rod 22 and includes a lower portion 27 arranged to have the middle portion 29 thereof located between the lower portion 27 thereof and the pivot shaft 25.

The vibrating device 4 includes a motor 40 and a reduction gearing device 41 disposed on the base 10 and coupled together with a coupling means or device 42 which includes a pulley 43 attached or secured to the reduction gearing device 41 and coupled to the spindle 44 of the motor 40 with a belt 45 for allowing the reduction gearing device 41 to be rotated or driven by the motor 40. However, the coupling device 42 may also be selected from the gearing coupling device 42, the sprocket-and-chain coupling device 42, the motorized threaded coupling device 42, or other suitable coupling devices.

The reduction gearing device 41 includes a crank or eccentric member 46 attached thereto or extended therefrom (FIGS. 3-6), such as extended from either the spindle 44 or the pulley 43 and coupled to the lower portion 27 of the first arm 24 (FIGS. 5, 6) with a lever 47 for allowing the arm 24 and thus the platform 50 to be rotated or driven or swung or vibrated by the motor 40 via or with the reduction gearing device 41 and the eccentric member 46 and the lever 47, such that the platform 50 and thus the user supported on the platform 50 may be swung or vibrated by the motor 40. It is preferable that the platform 50 are coupled to the housing 14 with a bellows type coupling member (not shown) for preventing a gap or slot from being formed between the platform 50 and the housing 14 and for preventing the user from being clamped or hurt by or between the platform 50 and the housing 14.

It is to be noted that the platform 50 may be pivotally coupled the motor 40 via or with the arm 24, the rod 22, the lever 47, the eccentric member 46, and the reduction gearing device 41, and may thus be effectively swung or vibrated by the motor 40, in order to effectively swing or vibrate the whole user' body and to facilitate the blood and/or lymph circulation of the user and to decompose or to burn the fatty tissue of the user and thus for suitably reducing the fat from the user. The lever 47, the eccentric member 46, and the reduction gearing device 41 may thus be formed or acted as a coupling means or mechanism or device for pivotally coupling the motor 40 to the platform 50.

Figure 4:
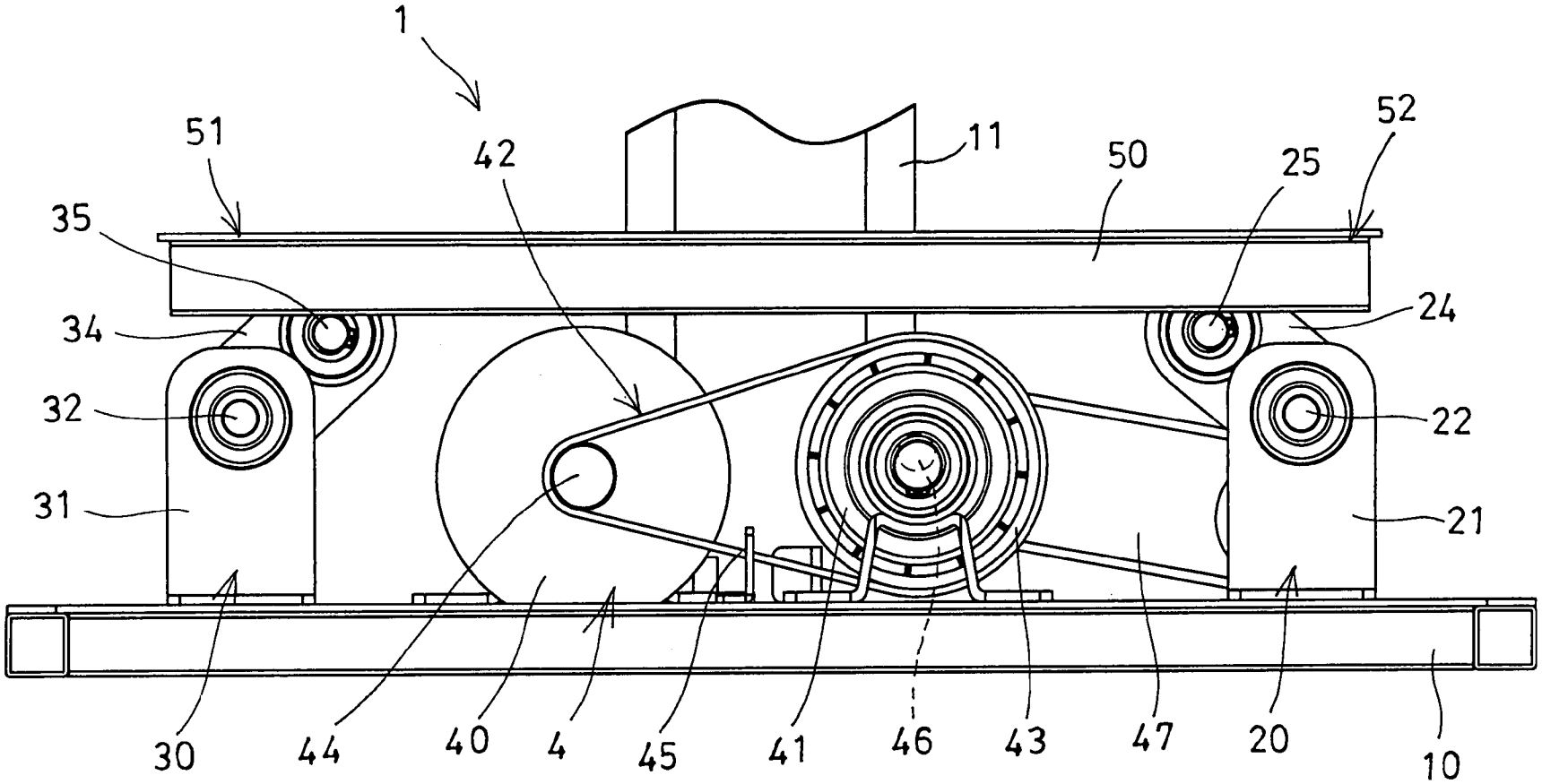
FIG. 4 is a partial side plan schematic view illustrating the vibrating device of the body vibrator.
Figure 5:
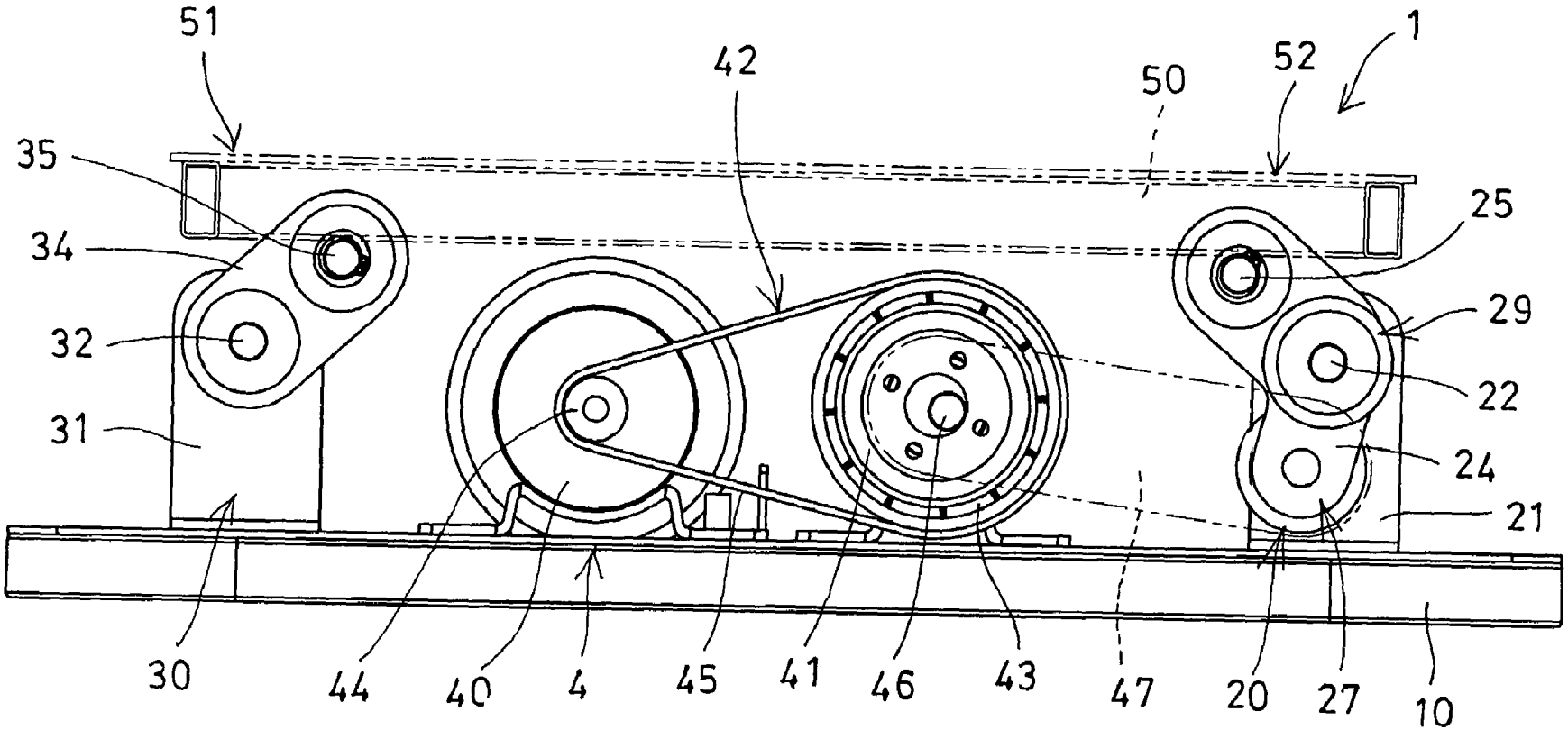
FIGS. 5, 6 are partial side plan schematic views similar to FIG. 4, illustrating the operation of the body vibrator.
Figure 6:
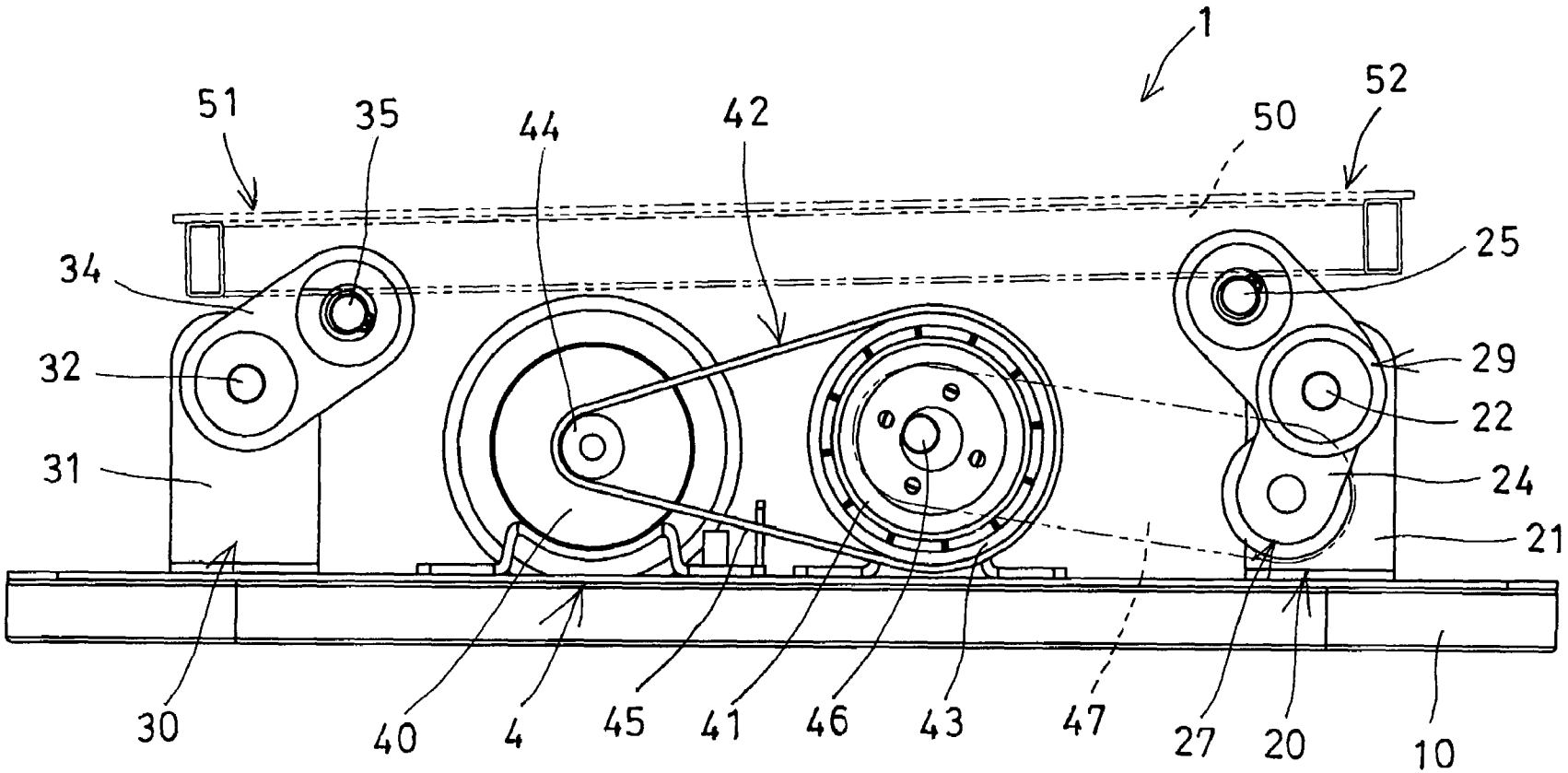

In operation, as shown in FIGS. 4-6, one side or the first or left side 51 of the platform 50 may be pivotally supported on the base 10 with the plates 31 and the arm 34 of the support devices 30 and arranged for allowing the left side 51 of the platform 50 to be slightly rotated or pivoted or swung or vibrated relative to the plates 31 of the support devices 30 and the base 10 for a relatively smaller moving or vibrating stroke. The other side or the second or right side 52 of the platform 50 may be pivotally supported on the base 10 with the plates 21 and the arm 24 and may be arranged for allowing the right side 52 of the platform 50 to be rotated or pivoted or swung or vibrated relative to the plates 21 of the support devices 20 and the base 10 by the motor 40 via or with the arm 24, the rod 22, the lever 47, the eccentric member 46, and the reduction gearing device 41.

Accordingly, the body vibrator in accordance with the present invention includes a stable structure for stably supporting a user thereon and for suitably vibrating and massaging the whole user' body and for facilitating the blood and/or lymph circulation of the user and for decomposing the fatty tissue and thus for suitably reducing the fat from the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A body vibrator comprising:

a base, a platform provided above said base, a first support device disposed on said base and including a first arm having a middle portion pivotally supported on said base and having a first end pivotally coupled to said platform for pivotally supporting said platform above said base and having a second end, a second support device disposed on said base and pivotally coupled to said platform for pivotally supporting said platform above said base, a reduction gearing device disposed on said base and including an eccentric member coupled to said second end of said first arm for allowing said first arm and said platform to be rotated and driven by said reduction gearing device, and a motor coupled to said reduction gearing device for driving said reduction gearing device to rotate and to vibrate said first arm and said platform.

2. The body vibrator as claimed in claim 1, wherein said motor includes a spindle, said reduction gearing device includes a pulley attached thereto and coupled to said spindle of said motor with a belt for allowing said reduction gearing device to be rotated and driven by said motor.

3. The body vibrator as claimed in claim 1, wherein said eccentric member of said reduction gearing device is coupled to said second end of said first arm with a lever for allowing said first arm and said platform to be rotated and driven by said reduction gearing device.

4. The body vibrator as claimed in claim 1, wherein said first support device includes two plates disposed on said base and spaced away from each other, and a rod rotatably attached to said plates and straddled between said plates for pivotally supporting said first arm on said plates of said first support device.

5. The body vibrator as claimed in claim 4, wherein said first arm includes at least two panels attached to said rod and secured to said platform for allowing said platform to be stably secured to and supported by said first arm and said rod.

6. The body vibrator as claimed in claim 1, wherein said second support device includes a second arm pivotally supported on said base and pivotally coupled to said platform for pivotally supporting said platform above said base.

7. The body vibrator as claimed in claim 6, wherein said second support device includes two plates disposed on said base and spaced away from each other, and a rod rotatably attached to said plates and straddled between said plates for pivotally supporting said second arm on said plates of said second support device.

8. The body vibrator as claimed in claim 1, wherein said base include a housing engaged thereon for covering and shielding said first and said second support devices, said motor and said reduction gearing device.

* * * * *